United States Patent [19]

Ruga

[11] 4,065,220

[45] Dec. 27, 1977

[54] STRUCTURAL SYSTEM CONNECTION

[76] Inventor: Wayne Ruga, 2163D Coosawattee Road, Atlanta, Ga. 30319

[21] Appl. No.: 705,885

[22] Filed: July 16, 1976

[51] Int. Cl.[2] ..... F16B 7/04

[52] U.S. Cl. ..... 403/169; 403/176; 46/29; 40/125 H; 52/665

[58] Field of Search ..... 403/169–171, 403/176, 178, 217; 52/645, 665, 758 H, 285; 46/29–31; 40/125 R, 125 H

[56] References Cited

U.S. PATENT DOCUMENTS

| | | | |
|---|---|---|---|
| 2,868,568 | 1/1959 | Frye | 403/171 |
| 2,888,072 | 5/1959 | Nicholas | 403/176 X |
| 3,399,914 | 9/1968 | Grant | 52/665 X |
| 3,554,382 | 1/1971 | Grinbergs | 46/31 X |
| 3,577,660 | 5/1971 | Kenney | 46/31 X |
| 3,641,701 | 2/1972 | Rosenfeld | 46/31 UX |
| 3,746,178 | 7/1973 | Wagschal | 46/31 X |

*Primary Examiner*—Wayne L. Shedd

*Attorney, Agent, or Firm*—B. J. Powell

[57] ABSTRACT

An interlocking structural system comprising a plurality of tubular strut members defining a central opening in the ends thereof of a prescribed diameter and at least one connector for selectively interconnecting the tubular strut members, the connector including a plurality of removably interconnected plate members with one of the plate members lying generally in a second plane intersecting the first plane so that the plate members intersect along a common line, each of the plate members defining a plurality of connector tangs thereon generally radially oriented with respect to the plate member where one of the connector tangs on one of the plate members intersects one of the connector tangs on another of the plate members along said common line and with the connector tangs sized to be received in the central opening in the end of one of the strut members so that the strut member can be slipped over the intersecting connector tangs to connect the strut member to the connector and to hold the plate members together.

8 Claims, 9 Drawing Figures

12
15
19
$A_R$
$A_P$
$t_1$
$t_2$
$d_1$
$d_3$
$W_1$
$W_2$
$W_r$ 10
11
12
14
15
19
38
39
40
42
44
45
46
49
50
51
52
35
36
$A_{RQ}$
$d_5$
$d_6$
$d_{10}$
$d_{11}$
$t_{10}$
$W_1$
$W_2$ 11
12
14
15
18
20
21
30
39
44
49
51
52
$t_1$
$t_2$
$d_4$

Fig 6
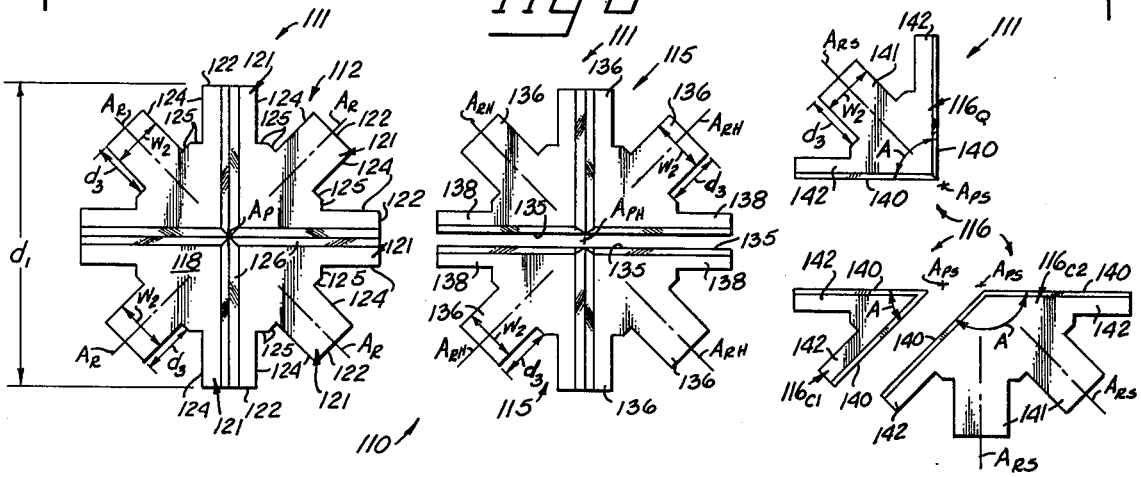
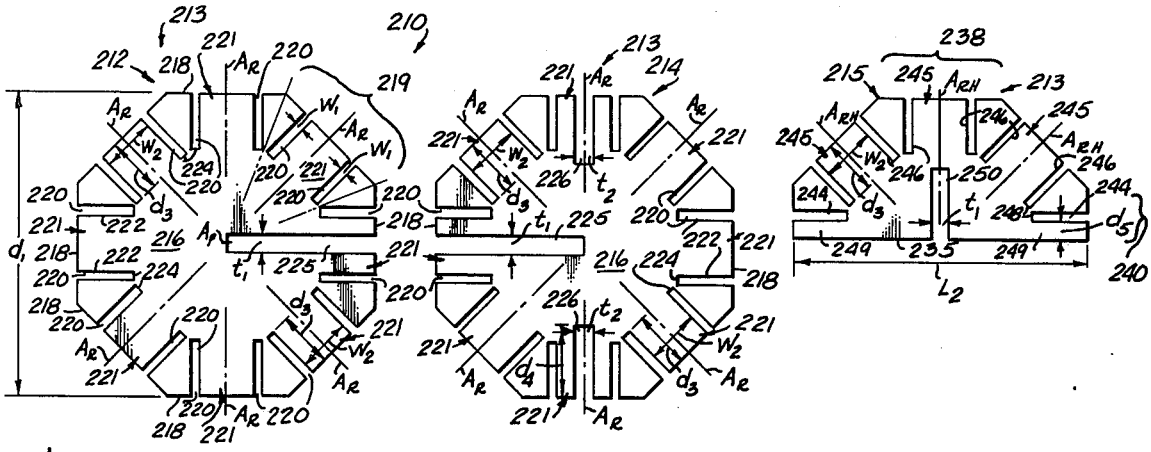
Fig 7
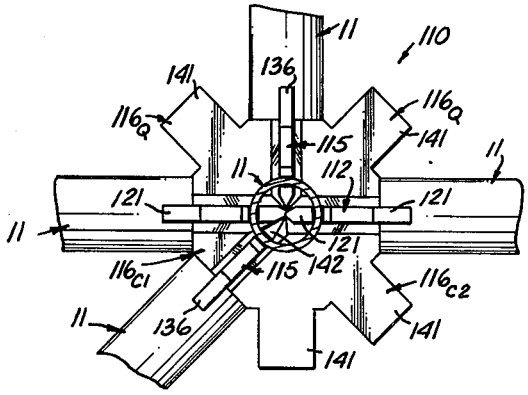
Fig 9

STRUCTURAL SYSTEM CONNECTION

BACKGROUND OF THE INVENTION

A number of skeletal structural systems are currently available which use strut members that are interconnected through connectors. One of the problems commonly associated with such structural systems is the use of relatively specialized connectors to connect the strut members to form the structure. This has resulted in limiting the number of structural configurations available using such connectors or have required a number of different type connectors designed to connect the strut members together in a particular configuration. Another problem that has been associated with these prior art structural systems is that the configuration of the connectors were of a fixed design which did not lend themselves to be rearranged to interlock the strut members in different configurations. Yet another problem that has been associated with prior art structural systems is that it was difficult to economically manufacture such a system while at the same time keeping the weight of the system at a minimum.

SUMMARY OF THE INVENTION

These and other problems and disadvantages associated with the prior art are overcome by the invention disclosed herein by providing a skeletal structural system using tubular strut members which are interlocked together through a universal type connector that allows a wide variety of structural configurations without the use of specialized components. Further, the weight of the system is minimized while at the same time minimizing the cost thereof because of the wide range of interchangeable components. Further, the connector which interlocks the tubular strut members of the system can be rearranged to different configurations to meet the required structural configuration.

The structural system of the invention comprises generally a universal type connector in which the configuration thereof can be rearranged to permit the connector to interlock the tubular strut members of the structural system in different system configurations. Each connector comprises a plurality of interconnected plate elements which provide connection points for the tubular strut members to form the structural system. The strut members may also serve to lock the connector together. This provides a structural system with a maximum number of degrees of freedom to provide an extremely wide variation in structural configurations. The plate elements may be assembled in different configurations and with different numbers of plate elements. Further, the connectors may be shipped disassembled to occupy the minimum space.

These and other features and advantages of the invention will become more clearly understood upon consideration of the following specification and accompanying drawings wherein like characters of reference designate corresponding parts throughout the several views and in which:

BRIEF DESCRIPTION OF THE DRAWINGS

FIG. 6 illustrates the components of a second embodiment of the connector;

FIG. 7 illustrates the components of a third embodiment of the connector;

FIG. 9 illustrates the assembled connector of FIG. 6 holding tubular members extending therefrom in five different directions.

Figure 1:
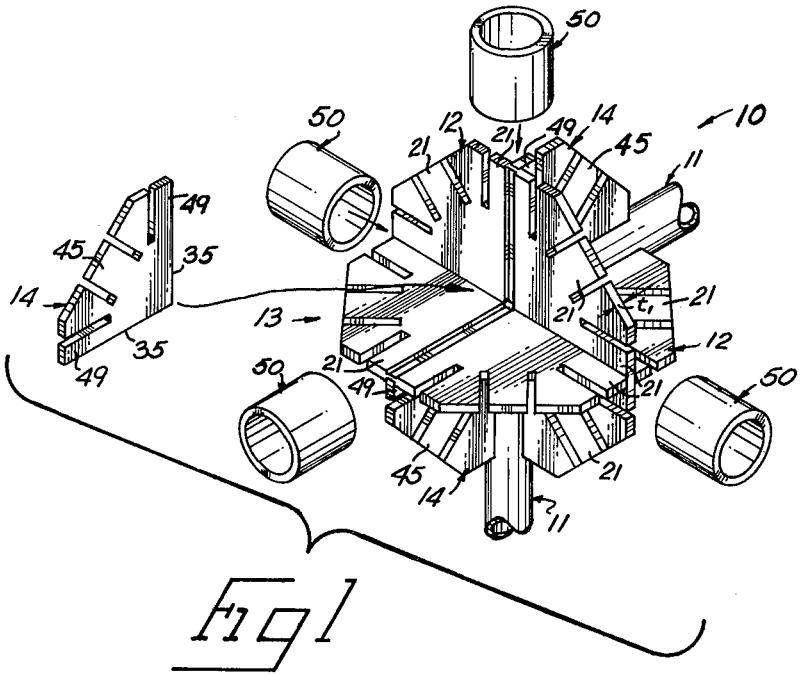
FIG. 1 is an exploded perspective view illustrating a first embodiment of the connector of the invention.

These figures and the following detailed description disclose specific embodiments of the invention, however, it is to be understood that the inventive concept is not limited thereto since it may be embodied in different forms.

DETAILED DESCRIPTION OF ILLUSTRATIVE EMBODIMENTS

Referring to FIGS. 1–5, it will be seen that the structural system of the invention includes a connector 10 which is used to interconnect a plurality of tubular strut members 11 to form a skeletal structure. The resulting skeletal structure may be used by itself or as a support for various coverings.

The connector 10 includes a plurality of plate elements 13 which fit together to connect the tubular strut members 11. The first embodiment of the connector 10 in FIGS. 1–5 uses a pair of base plates 12 of the same configuration and up to four quadrant plates 14 also of the same configuration to make the connector.

Figure 2:
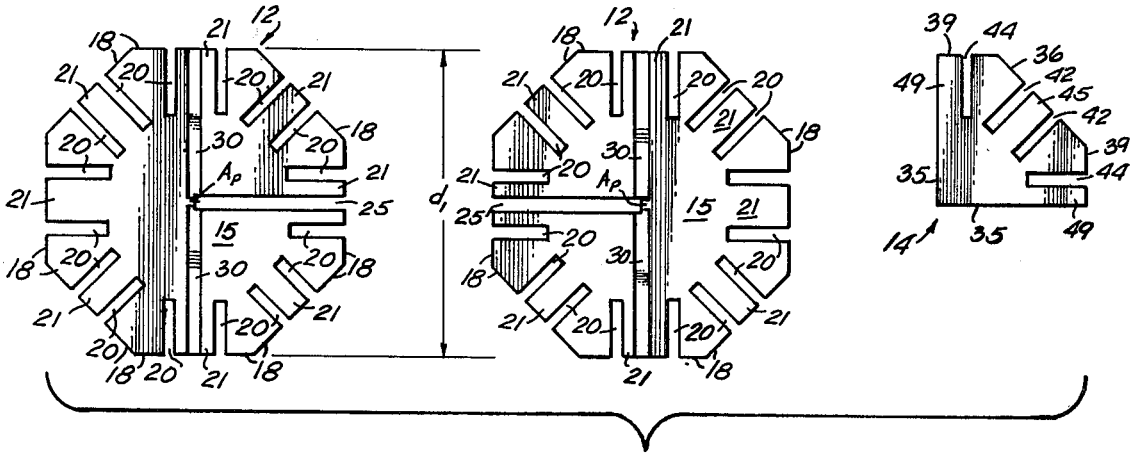
FIG. 2 illustrates the three basic components of the connector seen in FIG. 1.
Figure 3:
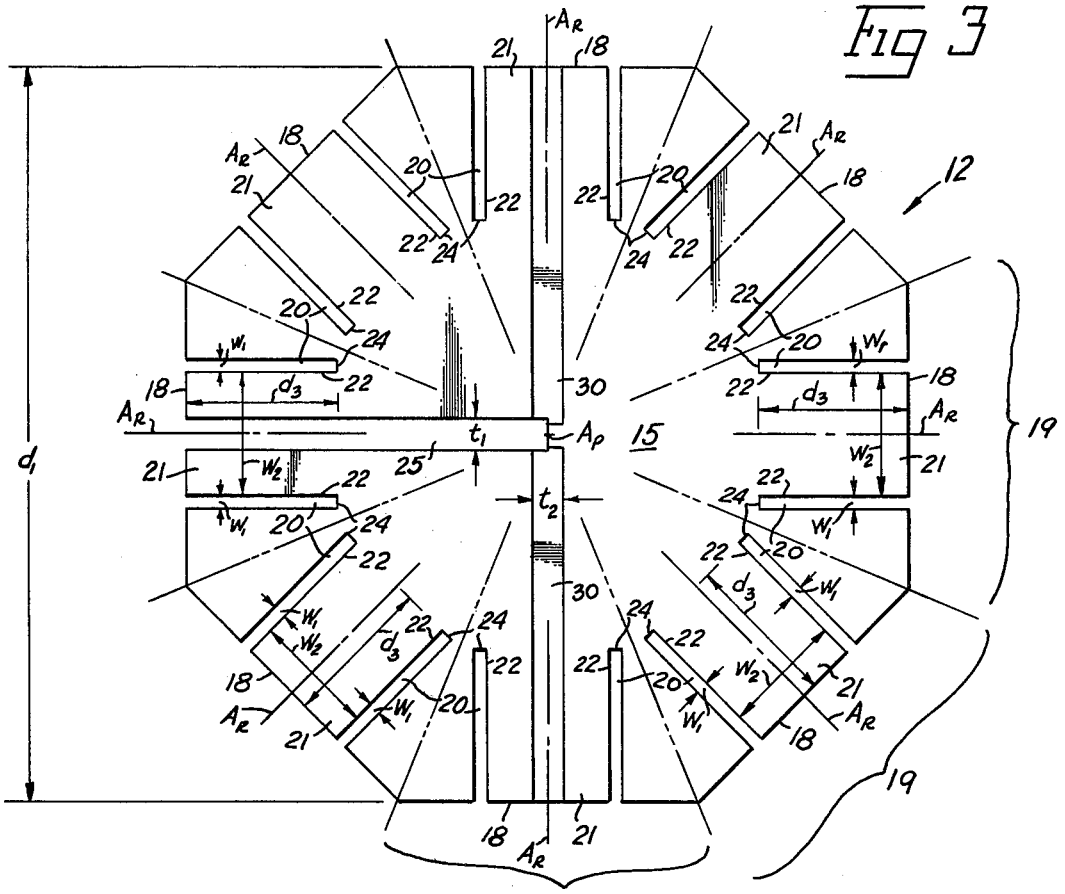
FIG. 3 is an enlarged face view of one of the plate elements of the connector of FIGS. 1 and 2.
Figure 5:
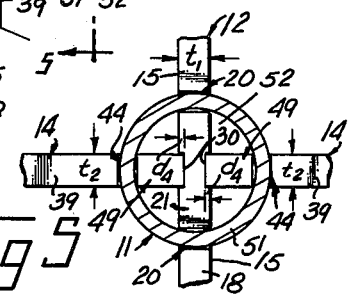
FIG. 5 is an enlarged cross-sectional view taken along line 5—5 in FIG. 4.

Each base plate 12 has a relatively thin thickness $t_1$ seen in FIGS. 1 and 5 as compared to its effective diameter $d_1$ seen in FIGS. 2 and 3 to define opposed parallel faces 15 on opposite sides thereof. Each base plate 12 has a central axis $A_p$ normal to faces 15. While the base plates 12 may have different peripheral shapes, an octagonal shape is illustrated with eight equal peripheral edges 18. Thus, it will be seen that each sector 19 of the base plate 12 shown by phantom lines in FIG. 3 associated with each of the peripheral edges 18 spans an included angle of 45° and is centered on a radial axis $A_R$.

Each of the sectors 19 is provided with a pair of strut slots 20 through the base plate 12 best seen in FIG. 3. The strut slots 20 are spaced equal distances on opposite sides of the radial axis $A_R$, are both parallel to axis $A_R$, open onto the peripheral edge 18 associated with the particular sector 19, and extend inwardly therefrom a distance $d_3$. Each strut slot 20 has a width $W_1$ seen in FIG. 3 as will be more fully explained. This forms a tang section 21 between slots 20 of a width $W_2$ and length $d_3$. Each of the side edges 22 of tang section 21 form one side of each of the slots 20 and an inboard abuttment edge 24 is defined at the inboard end of each slot 20. It will also be noted that the depth $d_3$ of slots 20 is sufficiently shorter than the diameter $d_1$ of base plate 12 so that the slots 20 in one sector 19 will not intersect the slots 20 in the adjacent sector 19.

Figure 4:
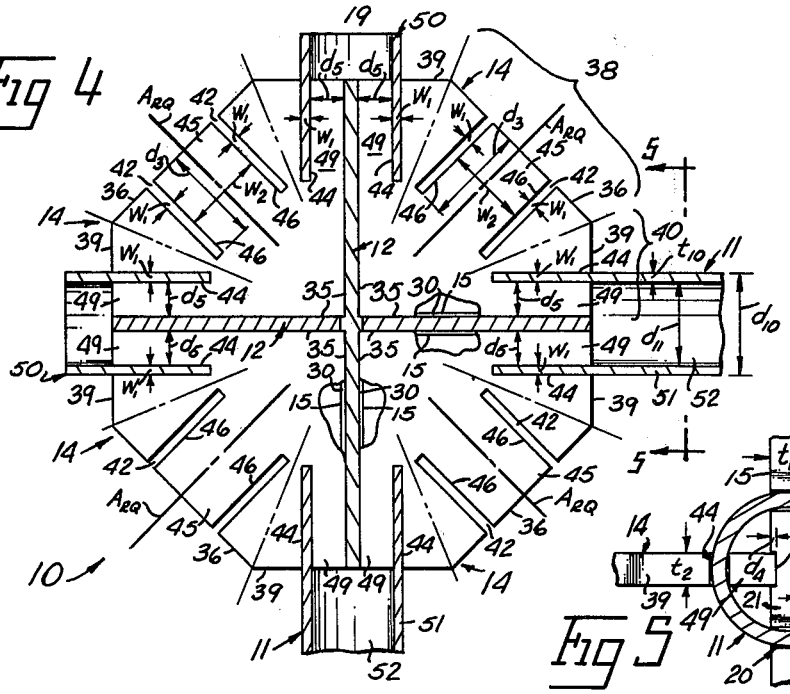
FIG. 4 is an enlarged cross-sectional view of the assembled connector in FIGS. 1 and 2.

For allowing the base plates 12 to be interlocked, each plate 12 has an interlock slot 25 therein which radially extends from one of the edges 18 to the center of the plate 12 as best seen in FIG. 3. The axis of the slot 25 is normal to edge 18 and centered on axis $A_R$ between the strut slots 20. The interlock slot 25 has a width $t_1$ (the thickness of plate 12) and a length about equal to one-half diameter $d_1$. When plates 12 are oriented so that the interlock slots 25 face each other and one plate 12 is perpendicular to the other plate 12, the plates 12 can be slipped together as seen in FIGS. 1 and 4. The plates 12 are now interconnected through slots 25 and intersect along a diametrical path. The opposite faces 15 of each plate 12 may be grooved as indicated at 30 in FIG. 3 to position the quadrant plates 14. The grooves 30 open onto the faces 15, are diametrically extending with respect to face 15 along axes $A_R$ and oriented normal to slot 25. The grooves 30 have a width $t_2$ (the thickness of the quadrant plates 14) so that the quadrant plates will slidably fit therein. It will be noted that two grooves 30 are illustrated on each face 15 of the base plates 12 as will become more apparent. The grooves 30 have a depth $d_4$ best seen in FIG. 5.

The quadrant plates 14 are basically one-fourth of the base plate 12. Like base plate 12, each quadrant plate 14 has a prescribed thickness $t_2$ (FIG. 5) illustrated as equal to the base plate thickness $t_1$. Each quadrant plate 14 has inboard edges 35 perpendicular to each other and with a length $L_2$ that is equal to one-half of the base plate diameter $d_1$ minus the base plate thickness $t_1$ plus the groove depth $d_4$. The central outboard peripheral edge 36 of the quadrant plate 14 corresponds in configuration to the peripheral edges 18 on the base plate 12 to form a central sector 38 corresponding to sector 19 on base plate 12 which is centered on a radial axis $A_{RQ}$ that defines a 45° angle with the inboard edges 35. A pair of outboard peripheral subedges 39 correspond in configuration to about one-half of the edge 18 on base plate 12 to form side sectors 40 centered on the inboard edges 35. The side sectors 40 correspond to about one-half of the sectors 19 on the base plates 12 so that when the quadrant plate 14 is placed on the interlocking base plates 12 as illustrated in FIGS. 1, 4 and 5, our of the quadrant plates 14 will correspond in shape to one of the base plates 12 as best seen in FIG. 4.

The central sector 38 of the quadrant plate 14 is provided with a pair of strut slots 42 through the base plate 14 as best seen in FIG. 4 which correspond in size and shape to the slots 20 in base plate 12; and are spaced equal distances on opposite sides of the radial axis $A_{RQ}$, are both parallel to the axis $A_{RQ}$, and open onto the peripheral edge 36. Each of the side sectors 40 are also slotted with a slot 44 which is parallel to the inboard edge 35 forming one side of the sector 40 and is located in the sector 40 a distance $d_5$ from the inboard edge 35 so that when the quadrant plates 14 are arranged as illustrated in FIG. 5, the slots 44 in adjacent quadrant plates 14 will have the same spacing as the slots 20 in the base plate 12 and the slots 42 in the quadrant plate 14.

The slots 42 and 44 have a width $w_1$ corresponding to the slots 20 in the base plate 12. It will be noted that the slots 42 form a tang section 45 of width $w_2$ and length $d_3$ between the slots 42 with slot side edges 46 corresponding to edges 22 on tang section 21. The inboard end of the slots 42 form an inboard abuttment edge 48 corresponding to the abuttment edge 24 on the base plate 12. The slot 44 in the side sectors 40 form a subtang 49 which is about one-half the width of the tang 45. When the quadrant plates 14 are positioned as seen in FIG. 4, the thickness of the base plate 12 in the grooves 30 is compensated for so that the adjacent pair of subtangs 49 have a total effective width in combination with the thickness of the base plate 12 corresponding to the spacing of slots 42 in plate 14 and slots 20 in plate 12.

The tubular strut members 11 include a seamless side wall 51 having an outside $d_{10}$ with a central passage 52 therethrough of diameter $d_{11}$. The diameter $d_{11}$ corresponds to the width $w_2$ of the tang 21 and 45 and corresponds to the combined assembled width of a pair of adjacent subtangs 49. The side wall 51 has a thickness $t_{10}$ that is usually about equal to the width $w_1$ of the slots 20, 42 or 44. This allows one end of the tubular strut member 11 to be inserted into any selected pair of slots 20, 42, or 44 of the assembled connector 10 as illustrated in FIG. 4. Preferably, the thickness $t_{10}$ should have a relationship with the width $w_1$ of the slots 20, 42 and 44 so that a snug fit is obtained as illustrated in FIG. 5. To insure good support of the tubular strut member 11 by the connector 10, the thickness $t_1$ of the base plates 12 and the thickness $t_2$ of the quadrant plates 14 should be about twice the thickness $t_{10}$ of the side wall 51 on the tubular strut member 11. Also, the length $d_3$ of the slots 20, 42 and 44 should be at least equal to the outside diameter $d_{10}$ of the tubular strut members 11 in order to give proper support to the ends of the tubular strut members 11.

It will be seen that the connector 10 may be made using at least the pair of base plates 12 which will give a connector with two degrees of freedom for placement of the tubular strut members 11. The quadrant plates 14 may be added to the base plates 12 as needed to allow tubular strut members 11 to be located in the third degree of freedom. FIG. 4 shows the connector 10 which uses four of the quadrant plates 14 and the base plates 12 to allow strut members 11 to be located in all three degrees of freedom. It will be noted that the strut members 11 connecting the tangs 21 of the base plates 12 where they intersect serve to positively lock the base plates 12 together. Those strut members 11 connecting the subtangs 49 on the quadrant plates 14 with the tangs 21 on the base plate 12 positively lock the quadrant plates 14 onto the base plate 12. Thus, it will be seen that the strut members 11 serve a dual function in that they carry a load while at the same time holding the connector 10 together. If no supporting strut member 11 is to be used at a position where tangs 21 intersect with each other or with the subtangs 49, then a short connector strut section 50 seen in FIGS. 1 and 8 may be used. The strut section 50 corresponds in cross-sectional shape and size to the strut members 11.

Figure 8:
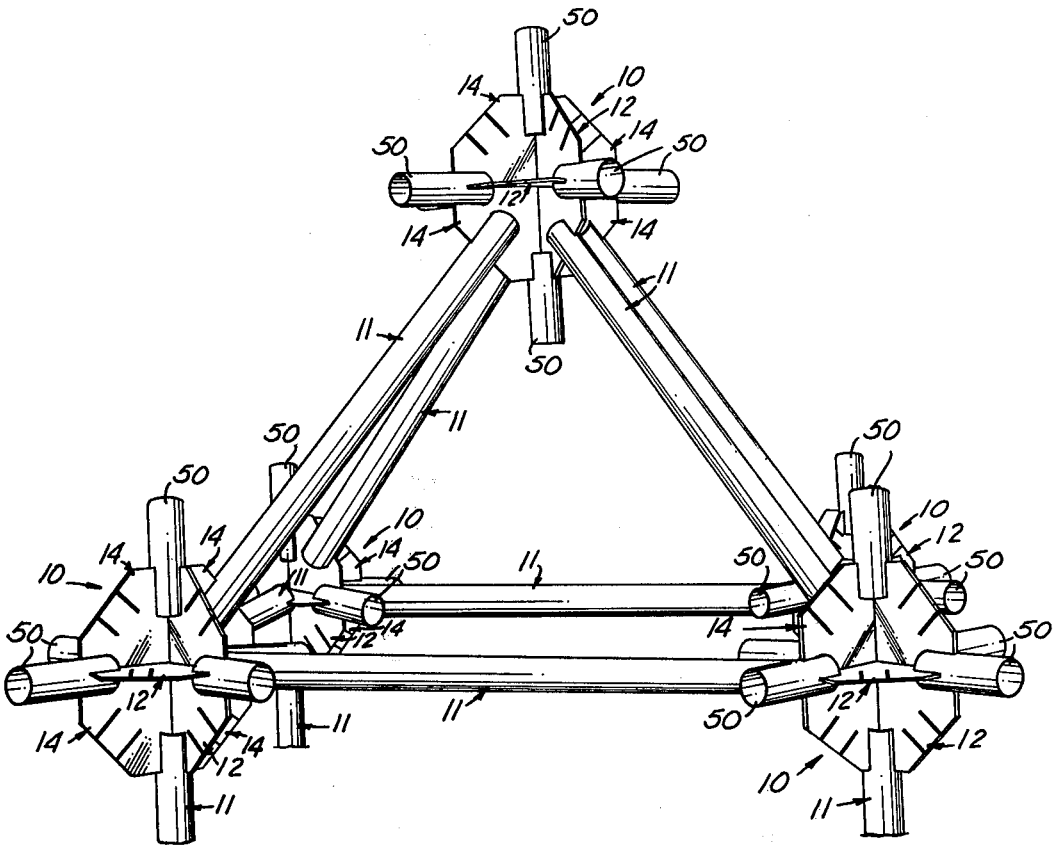
FIG. 8 is a perspective view of a structure using the connector of the invention.

FIG. 8 shows a skeletal structurel SS using the strut members 11 and connectors 10. The base strut members $11_b$ are anchored in the medium on which the structure SS is located such as the ground. Once assembled, the strut members 11 may be permanently attached to the connectors 10. A connector 10 using four of the quadrant plates 14 offers eighteen connection positions for the strut members 11.

SECOND EMBODIMENT OF CONNECTOR

Referring to FIG. 6, an alternate embodiment of the connector which is designated 110 is shown which is also used to interconnect a plurality of the tubular strut members 11 to form a skeletal structure. The connector 110 includes a plurality of plate elements 111 which fit together to connect the tubular strut members 11. The connector 110 uses a base plate 112, a pair of half plates 115 of the same configuration and up to four sector plates 116 to make the connector.

The base plate 112 has a relatively thin thickness similar to plate 12 of connector 10 as compared to its effective diameter $d_1$ seen in FIG. 6 to define opposed parallel faces 118 on opposite sides thereof. Base plate 112 has a central axis $A_p$ normal to faces 118. While the base plate 112 may have different peripheral shapes, an octagonal shape is illustrated. The base plate 112 is appropriately notched to form a plurality of tang sections 121 with width $W_2$ and length $d_3$. Each tang section 121 is oriented along radial axes $A_R$ oriented 45° apart about central axis $A_p$. The outboard peripheral end surface 122 of each tang section 121 is normal to axis $A_R$ and the side edges 124 of tang sections 121 are parallel to axis $A_R$. A pair of inboard abuttment shoulders 125 are defined at the inboard end of each tang 121 on opposite sides thereof. It will also be noted that the length $d_3$ of tang sections 121 is sufficiently shorter than the diameter $d_1$ of base plate 112 so that the tang sections 121 do not interfere with the adjacent tang sections 121. For allowing the half plates 115 and sector plates 116 to be oriented on base plate 112, plate 112 has V-shaped interlock grooves 126 therein which diametrically extend across the faces 118 along axis $A_R$. Two grooves 126 are provided across each face 118 and are arranged normal to each other.

The half plates 115 are basically one-half of the base plate 112. Like base plate 112, each half plate 115 has a prescribed thickness similar to plate 112. Each half plate 115 has a diametrically extending inside V-shaped edge 135 with a length aqual to diameter $d_1$ of base plate 112 so that the edge 135 can be placed in one of the grooves 126 in base plate 112 to orient the half plates 115 yet allow the half plate to pivot on edge 135 with respect to base plate 112. The half plates 115 are appropriately notched to form central tang sections 136 thereon about radial axis $A_{RH}$ from the central axis $A_{PH}$ of half plates 115. It will be noted that side tang sections 138 are formed adjacent opposite ends of the inside edge 135 that are about one-half the width $W_2$ of central tang sections 136. Central tang sections correspond in size and shape to tang sections 121 on base plate 112 and the side tang sections 138 on opposing half plates 115, when positioned on base plate 112, have a cumulative width equal to the width $W_2$ of tang sections 136 and 121. The sector plates 116 in FIG. 6 may all be quadrant plates $116_Q$ or may be in complimentary pairs of plates $116_{C1}$ and $116_{C2}$. All of the sector plates 116 have a prescribed thickness similar to plate 112. Each sector plate 116 has a pair of inside V-shaped edges 140 with a length equal to about one-half diameter $d_1$ of base plate 112 with an included angle A between edges 140. The angle A may be any convenient angle. Angle A is illustrated as 90° for quadrant plate $116_Q$, as 45° for complimentary plate $116_{C1}$, and as 135° for complimentary plate $116_{C2}$ so that when the edges 140 are placed in grooves 126 in base plate 112 and half plate 115, they orient half plates 115 with respect to base plate 112.

The sector plates 116 are appropriately notched to form central tang sections 141 and side tang sections 142 thereon about radial axes $A_{RS}$ from the central axis $A_{PS}$ of sector plates 116. It will be noted that the side tang sections 142 are formed adjacent opposite ends of the inside edges 140 and are about one-half the width $W_2$ of central tang sections 141. Central tang sections 141 correspond in size and shape to tang sections 121 on base plate 112 and the side tang sections 142 on opposing sector plates 116, when positioned on base plate 112 and half plate 115 have a cumulative width equal to the width $W_2$ of tang sections 141, 136 and 121.

The connector 110 connects strut members 11 similarly to connector 10 except that the angle of the half plates 115 do not have to be normal to base plate 112. This allows greater flexibility in connector 110. FIG. 9 illustrates the connector 110 assembled with one half plate 115 normal to base plate 112 and the other half plate 115 angled with respect to base plate 112 at a 45° included angle. It will further be understood that the tang sections 121, 136, 141 and 142 may be tapered to wedge the strut members 11 onto the tang sections.

THIRD EMBODIMENT OF CONNECTOR

Referring to FIG. 7, a third embodiment of the connector is designated and is used to interconnect a plurality of the tubular strut members 11 to form a skeletal structure.

The connector 210 includes a plurality of plate elements 213 which fit together to connect the tubular strut members 11. The connector 210 uses a primary base plate 212, a secondary base plate 214 and a pair of half plates 215 of the same configuration to make the connector.

Primary base plate 212 has a relatively thin thickness as compared to its effective diameter $d_1$ seen in FIG. 7 to define opposed parallel faces 216 on opposite sides thereof. Primary base plate 212 has a central axis $A_p$ normal to faces 216. While the primary base plate 212 may have different peripheral shapes, an octagonal shape is illustrated with eight equal peripheral edges 218. Thus, it will be seen that each sector 219 of the base plate 212 shown by phantom lines in FIG. 7 associated with each of the peripheral edges 218 spans an included angle of 45° and is centered on a radial axis $A_R$.

Each of the sectors 219 is provided with a pair of strut slots 220 through the base plate 212 best seen in FIG. 7. The strut slots 220 are spaced equal distances on opposite sides of the radial axis $A_R$, are both parallel to axis $A_R$, open onto the peripheral edge 218 associated with the particular sector 219, and extend inwardly therefrom a distance $d_3$. Each strut slot 220 has a width $W_1$ seen in FIG. 7 to form a tang section 221 between slots 220 of a width $W_2$ and length $d_3$. Each of the side edges 222 of tang section 221 form one side of each of the slots 220 and an inboard abuttment edge 224 is defined at the inboard end of each slot 220. It will also be noted that the depth $d_3$ of slots 220 is sufficiently shorter than the diameter $d_1$ of primary base plate 212 so that the slots 220 in one sector 219 will not intersect the slots 220 in the adjacent sector 219. For allowing the primary base plate 212 to be interlocked, onto the secondary base plate 214, base plate 212 has an interlock slot 225 therein which radially extends from one of the edges 218 to the center of the plate 212 as best seen in FIG. 7. The axis of the slot 225 is normal to edge 218 and centered on axis $A_R$ between the strut slots 220. The interlock slot 225 has a width $t_1$ (the thickness of plate 214) and a length about equal to one-half diameter $d_1$.

The secondary base plate 214 has the same configuration as primary base plate 212 and in addition defines a pair of opposed interlock subslots 226 therein. The subslots 226 are diametrically extending, oriented normal to slot 225 and lie along axes $A_R$ so that each subslot 226 opens onto one of the edges 218. The slots 226 have a width $t_2$ (the thickness of the half plates 215) so that the half plates 215 will slidably fit therein as will become more apparent. The slots 226 have a length $d_4$ about equal to one fourth of the diameter $d_1$ of secondary base plate 214.

When plates 212 and 214 are oriented so that the interlock slots 225 face each other and plate 212 is perpendicular to the plate 214, the plates 212 and 214 can be slipped together similar to connector 10. The plates 212 and 214 are now interconnected through slots 225 and intersect along a diametrical path.

The half plates 215 are basically one-half of the primary base plate 212. Each half plate 14 has a thickness similar to base plate 212. Each half plate 215 has an inboard edge 235 with a length $L_2$ that is equal to the base plate diameter $d_1$. The central outboard peripheral edges 236 of the half plate 215 correspond in configuration to the peripheral edges 218 on base plates 212 and 214 to form a central sector 238 corresponding to sectors 219 on base plates 212 and 214 which are centered on a radial axis $A_{RH}$ on 45° angle spacing. A pair of outboard peripheral subedges 239 adjacent the inboard edge 235 correspond in configuration to about one-half of the edge 218 on base plate 212 to form side sectors 240 centered on the inboard edge 235. The side sectors 240 correspond to about one-half of the sectors 219 on the base plate 212 so that when the half plate 215 is placed on the secondary base plate 214, two of the half plates 215 will correspond in shape to one of the base plates 212 or 214.

Each of the central sectors 238 of the half plate 215 is provided with a pair of strut slots 242 through the plate 215 as best seen in FIG. 7 which correspond in size to the slots 220 in base plate 212 and are spaced equal distances on opposite sides of the radial axis $A_{RH}$, are both parallel to the axis $A_{RH}$ and open onto the peripheral edge 236. Each of the side sectors 240 are also slotted with a slot 244 which is parallel to the inboard edge 235 forming one side of the sector 240 and is located in the sector 240 a distance $d_5$ from the inboard edge 235 so that when the half plates 215 are in position, the slots 244 in adjacent half plates 215 will have the same spacing as the slots 220 in the base plate 212 and the slots 242 in the half plate 215.

The slots 242 and 244 have a width $W_1$ corresponding to the slots 220 in the base plate 212. It will be noted that the slots 242 form a tang section 245 therebetween with slot side edges 246 corresponding to edges 222 on tang section 221. The inboard end of the slots 242 form an inboard abuttment edge 248 corresponding to the abuttment edge 224 in the base plate 212. The slot 244 in the side sectors 240 form a subtang 249 which is about one-half the width of the tang 245 so that when half plates 215 are in position, the thickness of the base plate 212 is compensated for. In this position, the spacing of adjacent slots 244 correspond to the spacing of slots 242.

For allowing the half plates 215 to be interlocked onto the secondary base plate 214, each half plate 215 has an interlock subslot 250 therein which radially extends outwardly from the edge 235 at its center as best seen in FIG. 7. The axis of the subslot 250 is normal to edge 235 and centered on axis $A_{RH}$ between the strut slots 242. The interlock subslot 250 has a width $t_1$ (the thickness of plate 214) and a length about equal to one-fourth diameter $d_1$. When half plates 215 are oriented so that the interlock subslots 250 face the interlock subslots 226 on plate 214 and plates 215 are perpendicular to the plate 214, the plates 215 can be slipped onto plate 214. The half plates 215 are now interconnected through subslots 226 and 250 so that they intersect with plate 214 along a diametrical path.

The connector 210 connects strut members 11 similarly to connector 10. It will be noted that the primary base plate 212 is positively positioned with respect to secondary base plate 214 by the interlock slots 225 while the half plates 215 are positively positioned with respect to the secondary base plate 214 and thus primary base plate 212 by interlock subslots 226 and 250.

It will be understood that a wide variety of materials may be used for the connectors 10, 110, or 210, the strut members 11, and the strut sections 50. The particular material used will depend on the strnegth required in the ultimate skeletal structure. Various metals, wood, fiberboard, concrete and fixed clay have been used satisfactorily.

I claim:

1. An interlocking structural system comprising:

a plurality of tubular strut members defining a central opening in the ends thereof of a prescribed diameter; and, at least one connector for selectively interconnecting said plurality of tubular strut members, said connector including a plurality of removably interconnected plate members, one of said plate members lying generally in a first plane; at least a second of said plate members lying generally in a second plane intersecting said first plane so that said plate members intersect along a first common line and at least a third of said plate members lying generally in a third plane transversely intersecting said first and second planes at a point of intersection intermediate the ends of said first common line, intersecting said first plane along a second common line and intersecting said second plane along a third common line; each of said plate members defining a plurality of connector tangs thereon generally radially oriented with respect to said plate member, one of said connector tangs on said one of said plate members intersecting one of said connector tangs on said another of said plate members along one of said common lines, said connector tangs sized to be received in said central opening in the end of one of said strut members so that said strut member can be slipped over said intersecting connector tangs to connect said strut member to said connector and to hold said plate members together whereby said connector, when assembled, supports said tubular struts simultaneously with said tubular struts holding said connector assembled.

2. The structural system of claim 1 wherein each of said plate elements further defines an abutment at the inboard end of said connector tangs to limit the movement of said strut members onto said connector tangs.

3. The structural system of claim 2 wherein said one and said second plate members include a pair of base plate members, each having a prescribed effective diameter and a peripheral edge, and defining a diametrically extending interlock slot opening onto said peripheral edge and extending into said base plate member a distance approximately one-half the effective diameter thereof so that said base plate members can be interconnected in said first and second planes by aligning said slots and sliding said base plate members together whereby said base plate members diametrically align with each other along said first common line.

4. The structural system of claim 3 wherein said third plate members further include sector shaped plate members adapted to be positioned on said base plate members in said third plane to maintain the angular spacing between said base plate members.

5. The structural system of claim 4 wherein each of said connector tangs and said abuttments in said plate members are formed by a pair of spaced apart slots defined in said plate members centered on a radial axis of said plate member.

6. The structural system of claim 1 wherein:

said one of said plate members includes a primary base plate member having a prescribed effective diameter and a primary peripheral edge, said primary base plate member divided into a plurality of equal angular primary sectors centered on a primary radial axis, each of said primary sectors defining a pair of spaced apart primary strut slots opening onto said primary peripheral edge and defining said connector tang therebetween centered on said primary radial axis, said primary base plate further defining a diametrically extending primary interlock slot therein opening onto said primary peripheral edge and extending into said primary base plate along one of said primary radial axes a distance approximately one-half the effective diameter of said primary base plate member;

said second of said plate members includes a secondary base plate member having a prescribed effective diameter about equal to the effective diameter of said primary base plate member, and a secondary peripheral edge, said second and base plate member divided into a plurality of equal angular secondary sectors, centered on a secondary radial axis, each of said sectors defining a pair of spaced apart secondary strut slots opening onto said secondary peripheral edge and defining said connector tang therebetween centered on said secondary radial axis, said secondary base plate further defining a diametrically extending secondary interlock slot therein opening onto said secondary peripheral edge and extending into said secondary base plate along one of said secondary radial axes a distance approximately one-half the effective diameter of said secondary base plate member so that said primary and secondary base plate members can be interconnected by aligning said primary and secondary interlock slots and sliding said primary and secondary base plate members together whereby said primary and secondary base plate members diametrically align with each other, said secondary base plate further defining a pair of opposed, diametrically extending interlocking secondary subslots therein, each of said subslots opening onto said secondary peripheral edge and extending into said secondary base plate member along one of said secondary radial axes normal to said secondary interlock slot a distance approximately one-fourth the effective diameter of said secondary base plate member; and, said third of said plate members includes at least one half plate member having a prescribed effective diameter about equal to the effective diameters of said primary and secondary plate members and corresponding to about one-half of said primary and secondary plate members, said half plate member having an inboard diametrically extending edge and a half peripheral edge extending between opposite ends of said inboard edge, said half plate member divided into a plurality of equal angular central sectors, each central sector centered on a half radial axis; and a pair of equal angular side sectors, each of said side sectors corresponding to about one-half of said central sector and centered on said inboard edge, each of said central sectors defining a pair of spaced apart central strut slots opening onto said half peripheral edge and defining said connector tang therebetween centered on said half radial axis, each of said side sectors defining a side strut slot therein opening onto said half peripheral edge and generally parallel to said inboard edge to define a subtang between said side strut slot and said inboard edge about equal to one-half the width of said connector tang of one of said central sectors; said half plate member further defining a radially extending interlocking half subslot therein opening onto said inboard edge and extending into said half plate member along one of said half radial axes normal to said inboard edge so that said secondary and half plate members can be interconnected by aligning said secondary and half interlocking subslot and sliding said secondary and half plate members together whereby said secondary and said half plate members diametrically align with each other and said half subtangs align with connector tangs on said primary base plate member.

7. The structural system of claim 1 wherein:

sad one of said plate members includes a primary base plate member having a prescribed effective diameter, a primary peripheral edge and opposed generally parallel base faces, said primary base plate member divided into a plurality of equal angular primary sectors centered on a primary radial axis, each of said primary sectors defining one of said connector tangs thereon centered on said primary radial axis, said primary base plate further defining a first diametrically extending primary interlock groove across each face of said base plate member, and a second diametrically extending interlock groove across each face of said base plate member normal to and intersecting said first interlock groove across each of said faces;

said second of said plate members includes at least one half plate member having opposed parallel half faces thereon and a prescribed effective diameter about equal to the effective diameter of said primary base plate member and corresponding to about one-half of said primary base plate member, said half plate member having an inboard diametrically extending edge adapted to be positioned in one of said interlock grooves on said primary base plate member and a half peripheral edge extending between opposite ends of said inboard edge, said half plate member divided into a plurality of equal angular central sectors, each central sector centered on a half radial axis; and a pair of equal angular side sectors, each of said side sectors corresponding to about one-half of said central sector and centered on said inboard edge, each of said central sectors defining one of said connector tangs thereon centered on said half radial axis, each of said side sectors defining a subtang thereon about equal to one-half the width of said connector tang of one of said central sectors; said half plate member further defining a radially extending interlocking half groove thereacross each face thereof along one of said half radial axes normal to said inboard edge; and, said third of said plate members includes at least one sector plate member having a prescribed radius about equal to one-half of said prescribed diameter of said primary base plate member, said sector plate member having a pair of intersecting inboard radial edges angularly located with respect to each other at an angle less than 180°, said inboard radial edges adapted to be positioned in one of said first interlock grooves and one of said second interlock grooves to angularly position said half plate member with respect to said primary base plate member, said sector plate member defining a sector subtang thereon adjacent the outboard end of each of said inboard radial edges about equal to one-half said connector tangs on said primary base plate member so that one of said sector subtangs align with one of said connector tangs on said primary base plate member and one of said sector subtangs align with one of said connector tangs on said half plate member.

8. The structural system of claim 1 wherein:

said one of said plate members includes a primary base plate member having a prescribed effective diameter and a primary peripheral edge, said primary base plate member divided into a plurality of equal angular primary sectors centered on a primary radial axis, each of said primary sectors defining a pair of spaced apart primary strut slots opening onto said primary peripheral edge and defining said connector tang therebetween centered on said primary radial axis, said primary base plate further defining a diametrically extending primary interlock slot therein opening onto said primary peripheral edge and extending into said primary base plate along one of said primary radial axes a distance approximately one-half the effective diameter of said primary base plate member;

said second of said plate members includes a secondary base plate member having a prescribed effective diameter about equal to the effective diameter of said primary base plate member and a secondary peripheral edge, said secondary base plate member divided into a plurality of equal angular secondary sectors centered on a secondary radial axis, each of said sectors defining a pair of spaced apart secondary strut slots opening onto said secondary peripheral edge and defining said connector tang therebetween centered on said secondary radial axis, said secondary base plate further defining a diametrically extending secondary interlock slot therein opening onto said secondary peripheral edge and extending into said secondary base plate along one of said secondary radial axes a distance approximately one-half the effective diameter of said secondary base plate member so that said primary and secondary base plate members can be interconnected by aligning said primary and secondary interlock slots and sliding said primary and secondary base plate members together whereby said primary and secondary base plate members diametrically align with each other;

said third of said plate members includes at least one quadrant plate member having a prescribed effective radius about equal to one-half the effective diameters of said primary and secondary plate members and corresponding to about one-fourth of said primary and secondary plate members, said quadrant plate member having a pair of inboard radially extending edges normal to each other and a quadrant peripheral edge extending between outboard ends of said inboard edges, said quadrant plate member divided into a central sector centered on a quadrant radial axis; and a pair of equal angular side sectors, each of said side sectors corresponding to about one-half of said central sector and centered on one of said inboard edges, said central sector defining a pair of spaced apart central strut slots opening onto said quadrant peripheral edge and defining said connector tang therebetween centered on said quadrant radial axis, each of said side sectors defining a side strut slot therein opening onto said quadrant peripheral edge and generally parallel to the adjacent said inboard edge to define a subtang between said side strut slot and said inboard edge about equal to one-half the width of said connector tang of said central sector so that said quadrant plate member angularly positions said primary and secondary plate members normal to each other when said primary plate member lies against one of said inboard edges and said secondary plate member lies against the other of said inboard edges.

* * * * *